US010262559B2

(12) United States Patent
Hinch et al.

(10) Patent No.: US 10,262,559 B2
(45) Date of Patent: Apr. 16, 2019

(54) FOLDABLE MULTI-PANEL DISPLAY

(71) Applicant: INTERNATIONAL PAPER COMPANY, Memphis, TN (US)

(72) Inventors: William Edward Hinch, Marlton, NJ (US); Jeffrey Lynn Gross, Thorofare, NJ (US); Bernard Frank Baszak, II, York, PA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 15/346,426

(22) Filed: Nov. 8, 2016

(65) Prior Publication Data

US 2018/0130382 A1 May 10, 2018

(51) Int. Cl.
*G09F 1/00* (2006.01)
*G09F 1/06* (2006.01)

(52) U.S. Cl.
CPC ..... *G09F 1/065* (2013.01)

(58) Field of Classification Search
CPC ..... G09F 15/0062; G09F 15/0025; G09F 15/0068; G09F 7/18; G09F 1/06; G09F 1/08; G09F 1/04; G09F 19/10; E01F 9/012; A47F 5/112
See application file for complete search history.

(56) References Cited

U.S. PATENT DOCUMENTS

| | | | | |
|---|---|---|---|---|
| 2,283,406 | A | 5/1942 | Bacon | |
| 7,159,350 | B2 | 1/2007 | L'Hotel | |
| 9,783,362 | B2 * | 10/2017 | Boyea | B65F 1/10 |
| 2009/0119956 | A1 | 5/2009 | Martin Presa | |
| 2011/0088300 | A1 | 4/2011 | Martin Presa | |
| 2017/0004746 | A1 * | 1/2017 | Debarros | G09F 1/065 |
| 2017/0249874 | A1 * | 8/2017 | Lopez Fern Ndez | G09F 1/065 |

FOREIGN PATENT DOCUMENTS

| | | | |
|---|---|---|---|
| WO | WO-9936900 | A1 | 7/1999 |
| WO | WO-2006037896 | A2 | 4/2006 |

* cited by examiner

*Primary Examiner* — Cassandra Davis
(74) *Attorney, Agent, or Firm* — Thomas W. Ryan; Rebecca M. Greendyke

(57) ABSTRACT

A foldable display comprising: a sleeve, two inserts spaced apart in an interior of the sleeve, and an elastic member comprising a first end coupled to one insert and a second end coupled to the other insert such that the elastic member extends between the two inserts. Each insert is coupled to an interior surface of the sleeve. When the display is in a collapsed position, the sleeve is in a flattened state and each insert is in a folded position that increases a distance between the two inserts. When the display is in a deployed position, each insert is in an unfolded position that decreases the distance between the two inserts. One or more sections of an outer perimeter of each insert contact one or more adjacent sections of the interior surface of the sleeve and bias the sleeve outward such that the sleeve forms a three-dimensional figure.

19 Claims, 10 Drawing Sheets

FOLDABLE MULTI-PANEL DISPLAY

FIELD OF THE INVENTION

This invention relates generally to a foldable display that comprises a sleeve and one or more pairs of inserts and that is at least partially self-deploying.

BACKGROUND OF THE INVENTION

Conventional, multi-panel display units typically utilize holding tabs or strips that each receive an elastic band that holds the display unit together to form one or more outer faces for displaying information. Each display unit requires multiple elastic bands, and each holding strip typically includes multiple intricate cuts, all of which contribute to greater labor and cost for manufacturing. The larger number of individual components also increases the difficulty for the consumer in assembling the display unit and may cause greater wear and tear over time. In addition, portions of one or more of the outer faces of the display unit are often unusable, as information cannot be displayed on or over the holding strips.

SUMMARY OF THE INVENTION

In accordance with one aspect of the present disclosure, a foldable display comprises a sleeve, two inserts spaced apart in an interior of the sleeve, and an elastic member comprising a first end coupled to one of the two inserts and a second end coupled to the other of the two inserts such that the elastic member extends between the two inserts. The sleeve comprises a plurality of connected foldable panels and defines a longitudinal axis. Each insert is coupled to an adjacent portion of an interior surface of the sleeve. When the foldable display is in a collapsed position, the sleeve is in a flattened state and each insert is in a folded position that increases a distance between the two inserts and causes the elastic member to stretch. When the foldable display is in a deployed position, each insert is in an unfolded position that decreases the distance between the two inserts. One or more sections of an outer perimeter of each insert contact one or more adjacent sections of the interior surface of the sleeve and bias the sleeve outward such that the sleeve forms a three-dimensional figure.

In accordance with some aspects of the present disclosure, the elastic member may move to a lower tension state when the inserts move from their folded position to their unfolded position. In accordance with other aspects of the present disclosure, the elastic member may extend between the two inserts substantially along the longitudinal axis of the sleeve.

In accordance with further aspects of the present disclosure, each insert may comprise a hinge line, and the elastic member may be coupled to the hinge line of the two inserts. When the foldable display is in the collapsed state, each insert is folded along the hinge line such that a portion of each insert moves away from a corresponding portion of the other insert to increase the distance between the two inserts. When the foldable display is in the deployed state, each insert is unfolded such that the portion of each insert moves toward the corresponding portion of the other insert to decrease the distance between the two inserts.

In accordance with additional aspects of the present disclosure, when the foldable display is in the deployed state, each insert may be substantially planar and may be substantially perpendicular to the longitudinal axis of the sleeve.

In accordance with other aspects of the present disclosure, a cross-sectional shape of the three-dimensional figure may comprise one of a curved geometric figure or a polygon. In accordance with particular aspects of the present disclosure, a shape of the outer perimeter of each insert, when in its unfolded position, may substantially correspond to the cross-sectional shape of the three-dimensional figure, and the outer perimeter of each insert may substantially correspond to an internal perimeter of the sleeve. In accordance with other particular aspects of the present disclosure, at least one of the internal perimeter of the sleeve or the cross-sectional shape of the three-dimensional figure may vary along at least a portion of the longitudinal axis of the sleeve.

In accordance with some aspects of the present disclosure, each insert may comprise one or more cutouts located inward from the outer perimeter of the insert. In accordance with further aspects of the present disclosure, each insert may comprise at least one hole through which one or more fingers are inserted for moving the foldable display between the deployed position and the collapsed position. In accordance with yet further aspects of the present disclosure, each insert may comprise two or more tabs extending from the outer perimeter of the insert for coupling the insert to the adjacent portion of the interior surface of the sleeve.

In accordance with additional aspects of the present disclosure, a force generated by the elastic member being in tension when the inserts are in their folded positions may bias each insert toward its unfolded position such that the foldable display is at least partially self-deploying.

In accordance with further aspects of the present disclosure, the sleeve may comprise a midsection defining a first sleeve portion and a second sleeve portion, in which one of the inserts may be located in the first sleeve portion and the other of the inserts may be located in the second sleeve portion.

In accordance with yet further aspects of the present disclosure, the sleeve may comprise a plurality of fold lines extending substantially perpendicular to the longitudinal axis of the sleeve and defining the plurality of connected foldable panels. In accordance with particular aspects of the present disclosure, each insert may be located within one of the panels, and the sleeve may be foldable along the fold lines such that when the foldable display is in the collapsed position, the panels are folded in opposing directions, to form a folded display. In accordance with other particular aspects of the present disclosure, the folded display is substantially planar. In accordance with further particular aspects of the present disclosure, the foldable display may further comprise one or more additional panels, in which the one or more additional panels comprise at least one of a detachable panel or a telescoping panel.

In accordance with some aspects of the present disclosure, the foldable display may further comprise at least one of a cap or a base.

In accordance with a second aspect of the present disclosure, a foldable display comprises a sleeve, at least one pair of inserts spaced apart in an interior of the sleeve, and an elastic member extending between the inserts in each pair of inserts. The sleeve comprises a plurality of connected foldable sections and defines a longitudinal axis. Each insert is coupled to an adjacent portion of an interior surface of the sleeve. A first end of the elastic member is coupled to one of the inserts and a second end of the elastic member is coupled to the other of the inserts. When the foldable display is in a collapsed position, the sleeve is in a flattened state and the inserts are in a folded position that increases a distance between the inserts in each pair of inserts and causes the respective elastic member to stretch. When the foldable display is in a deployed state, the inserts are in an unfolded position that decreases the distance between the inserts in each pair of inserts and causes ends of the respective elastic member to move closer to one another. One or more sections of an outer perimeter of each insert contact one or more adjacent sections of the interior surface of the sleeve and bias the sleeve outward such that the sleeve forms a three-dimensional figure.

In accordance with some aspects of the present disclosure, the foldable display may comprise at least two pairs of inserts, and the sleeve may comprise at least one window. Each pair of inserts may be located above or below the at least one window.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
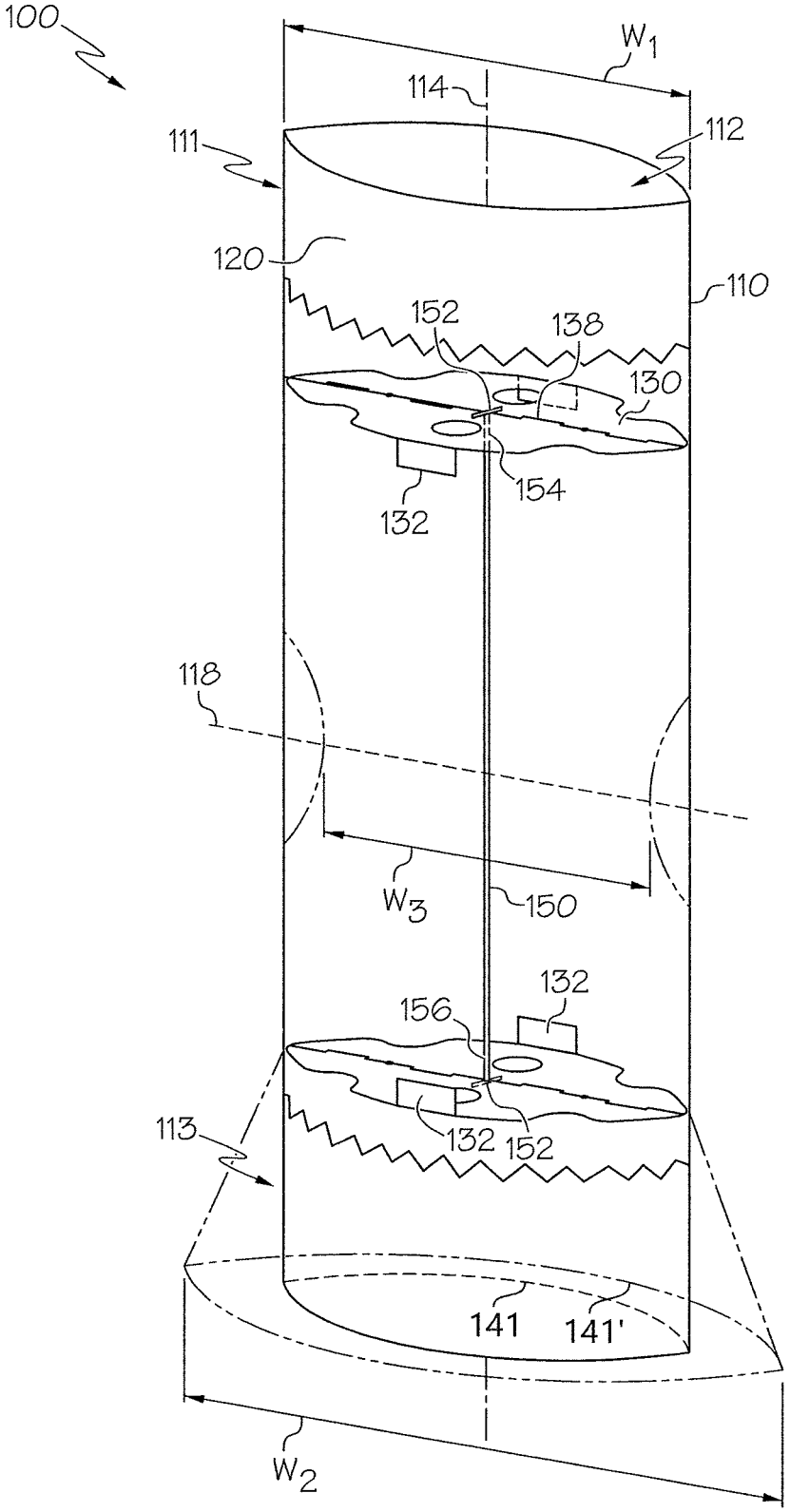
FIG. 1 is a perspective view of an embodiment of a display in a deployed position, in accordance with the present disclosure, in which a portion of the sleeve is cut away to illustrate the internal structure of the display.
Figure 2:
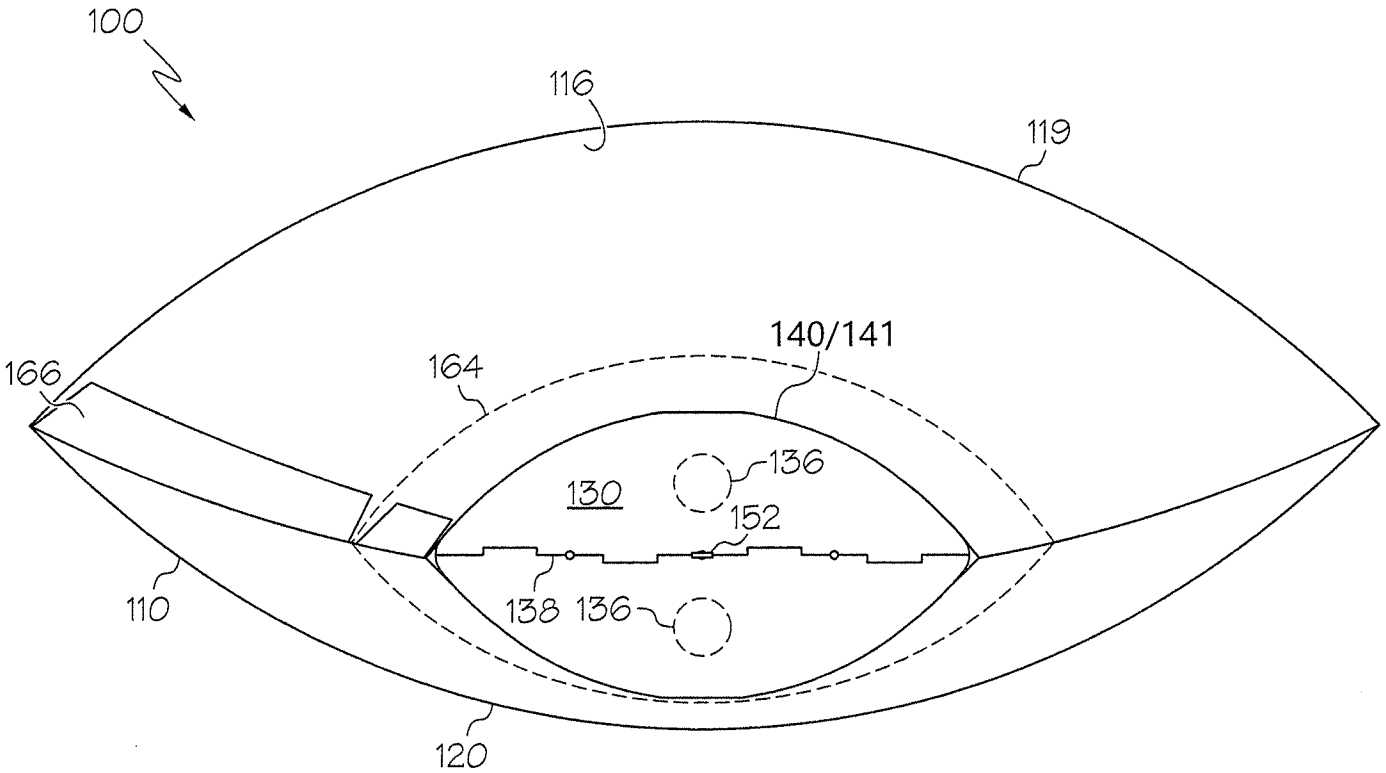
FIG. 2 is an enlarged, perspective view of an end portion of the display of FIG. 1.
Figure 9:
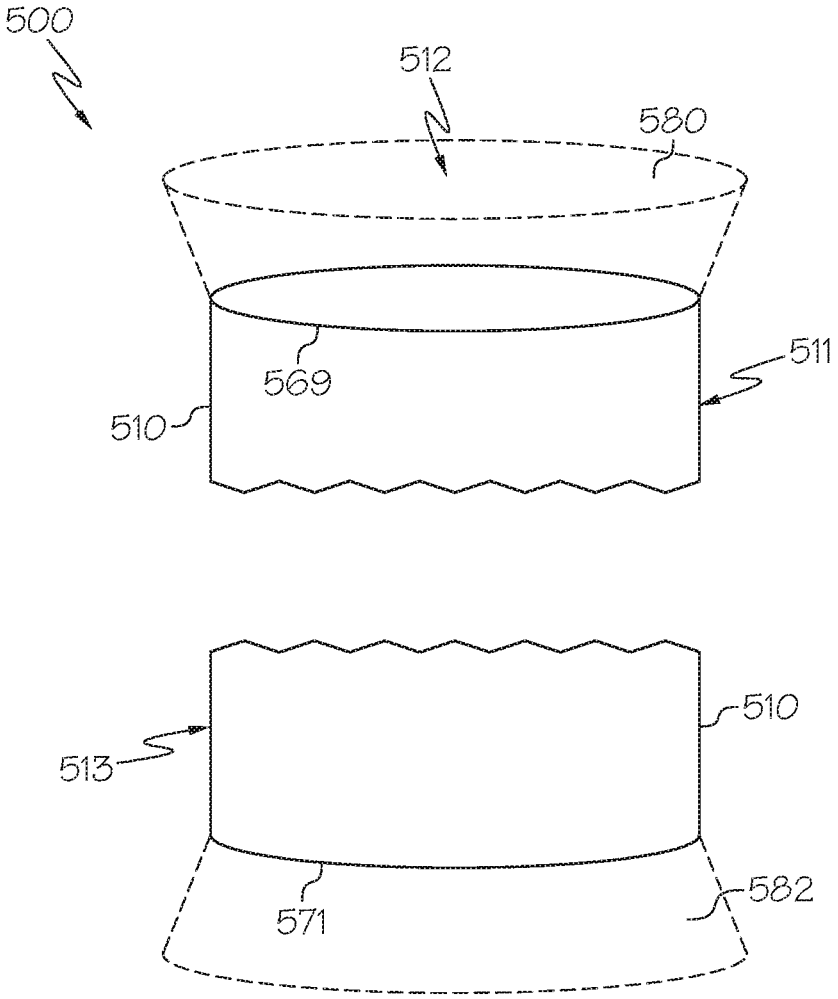
FIG. 9 is a perspective view of an embodiment of a display comprising one or more of a cap and a base, in accordance with the present disclosure.

With reference to FIGS. 1 and 2, a foldable display 100 in a fully set up or deployed position is illustrated. The display 100 comprises a sleeve 110 with a hollow interior 112, a first end portion 111, and a second end portion 113 and defining a vertical or longitudinal axis 114. The sleeve 110 also comprises a transverse or lateral axis 118 extending through a midsection of the sleeve 110 and dividing the sleeve 110 into two halves comprising a first sleeve portion and a second sleeve portion (not labeled). In the embodiment shown in FIGS. 1 and 2, the display 100 is substantially columnar and both end portions 111, 113 of the sleeve 110 are open. In other embodiments, one or more of the end portions 111, 113 of the sleeve 110 may be fully or partially closed (FIG. 9).

As shown in the cutaway portion of the sleeve 110 in FIG. 1, the display 100 further comprises two inserts 130 that are spaced apart in the interior 112 of the sleeve 110. In embodiments with two inserts 130 as shown, the inserts 130 may be located on either side of the lateral axis 118 of the sleeve 110, in which one insert 130 is located in the first sleeve portion and the other insert 130 is located in the second sleeve portion. The inserts 130 are coupled to an interior surface 116 of the sleeve 110. For example, each insert 130 may comprise a plurality of tabs 132 that are coupled to an attachment point (reference number 172 in FIG. 4) located on the interior surface 116 of the sleeve, as described herein.

An elastic member 150 extends between the two inserts 130, as shown in FIG. 1. The elastic member 150 may comprise an elastic material such as an elastic band or cord that undergoes elastic deformation upon application of a force and generally returns to its original length when the force is removed. A first end 154 of the elastic member 150 is coupled to one of the two inserts 130, and a second end 156 of the elastic member 150 is coupled to the other of the two inserts 130. The elastic member 150 may extend substantially along the longitudinal axis 114 of the sleeve 110. Each end 154, 156 of the elastic member 150 may comprise, for example, a barb 152 or other suitable fastener or retention element such as a ball or knot that couples each end 154, 156 of the elastic member 150 to a respective one of the inserts 130.

Figure 3A:
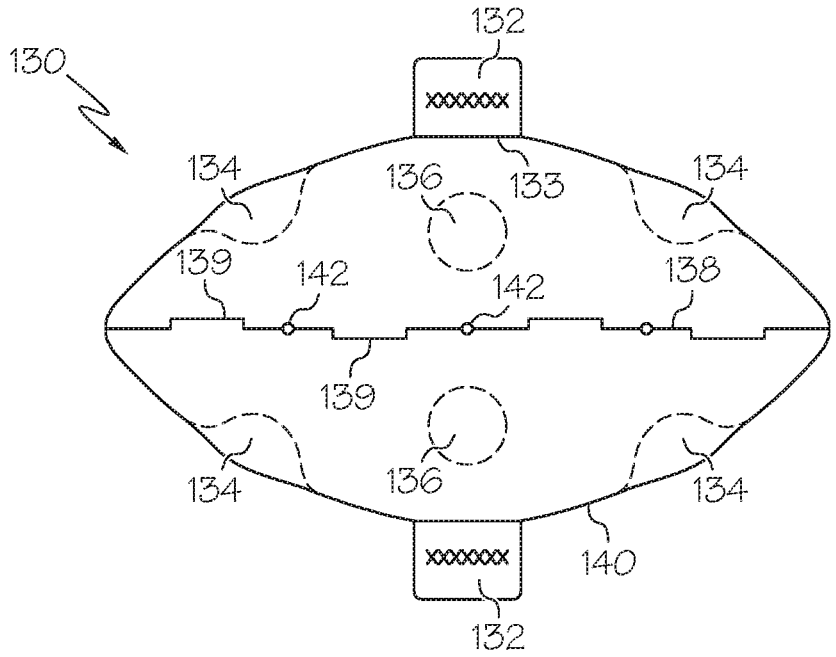
FIGS. 3A and 3B are top views of inserts for use in a display, in accordance with the present disclosure.
Figure 3B:
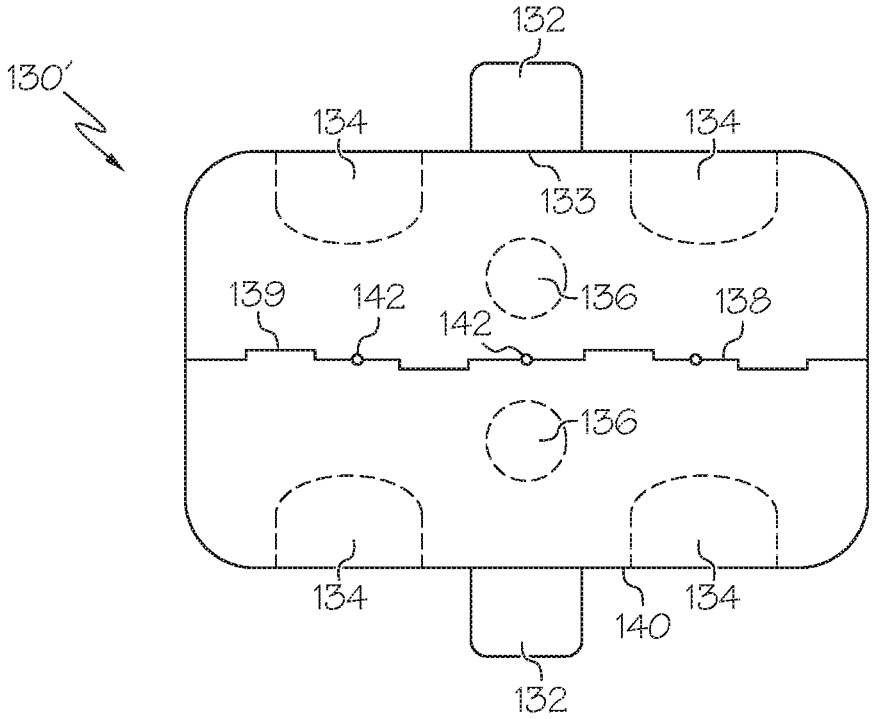

Several embodiments of the inserts 130, 130' are illustrated in detail in FIGS. 2, 3A, and 3B. Each insert 130, 130' may comprise plurality of tabs 132 extending from an outer perimeter 140 of the insert 130, 130'. The tabs 132 fold along a fold line, such as a perforated or scored fold line 133, as described herein. A portion of the outer perimeter 140 of each insert 130, 130' defines a geometric shape. In the embodiment shown in FIGS. 1, 2, and 3A, the insert 130 comprises a geometric shape that substantially corresponds to a symmetric lens shape. The insert 130 may also comprise other geometric shapes with one or more curves, including a circle, an oval, an ellipse, a circular segment, or an asymmetric lens (not shown). In the embodiment shown in FIG. 3B, the insert 130' comprises a substantially rectangular shape. The insert 130' may also comprise another polygon, including a triangle, a square, or any other suitable, multi-sided geometric shape. In some embodiments, one or more points at which adjacent sides of the geometric shape of the insert 130, 130' meet may be slightly rounded. For example, as shown FIGS. 3A and 3B, the two endpoints of the insert 130 and the four corner points of the insert 130' are slightly rounded.

Each insert 130, 130' comprises a hinge line 138 along which the insert 130, 130' folds. As shown in FIGS. 3A and 3B, the hinge line 138 may be located substantially along a longitudinal centerline (e.g., a major axis) of the insert 130, 130'. The hinge line 138 may comprise a stair-step or squared sawtooth configuration with a plurality of projections 139 extending from either side of the longitudinal centerline. In some embodiments, an outline of the projections 139 is cut through a thickness of the insert 130, 130', while a portion of the hinge line 138 between the projections 139 is scored, perforated, or cut partially through the thickness, which allows the insert 130, 130' to fold or pivot along the hinge line 138, as described herein. In some embodiments, scoring, partial cuts, or perforations of the hinge line 138 between the projections 139 prevents or resists folding of the insert 130, 130' in one direction. In another embodiment, all or a substantial portion of the entire length of the hinge line 138 is scored.

The inserts 130, 130' may optionally comprise one or more recesses or cutouts 134 located inward from the outer perimeter 140. As shown in FIGS. 1, 3A, and 3B, one or more cutouts 134 may extend inward from the outer perimeter 140 of each insert 130, 130'. The cutouts 134 may reduce an amount of friction generated by repeated folding and unfolding of the inserts 130, 130' as the display is moved between the deployed position and a folded or collapsed position, as described herein. In addition, the cutouts 134 may reduce a total weight of the display 100 and may reduce an amount of material required to fabricate the display 100. The inserts 130, 130' may also comprise one or more holes 136 extending through a thickness of the insert 130, 130' through which one or more fingers may be inserted for moving the display 100 between the deployed position and a collapsed position, as described herein. The holes 136 may be located on either side of the hinge line 138, as shown in FIGS. 3A and 3B. The hinge line 138 may also comprise one or more small holes 142 extending through a thickness of the insert 130, 130', to which the ends 154, 156 of the elastic member 150 may be coupled. For example, as shown in FIGS. 1 and 2, the barb 152 on each end 154, 156 of the elastic member 150 may be inserted through a corresponding one of the holes 142 in each insert 130.

When in use, the display 100 is in the deployed position, as shown in FIGS. 1 and 2, in which the inserts 130 are substantially planar and are substantially perpendicular to the longitudinal axis 114 of the sleeve 110. As best seen in FIG. 2, a dimension of the outer perimeter 140 of the inserts 130 substantially corresponds to an internal perimeter 141 of the sleeve 110, and one or more sections of the outer perimeter 140 of each insert 130 contact one or more adjacent sections of the interior surface 116 of the sleeve 110. The contact between the inserts 130 and the interior surface 116 of the sleeve 110 biases the sleeve 110 outward to its deployed position such that the sleeve 110 forms a three-dimensional figure.

A cross-sectional shape of the three-dimensional figure, e.g., a cross-section substantially parallel to the lateral axis 118 and substantially perpendicular to the vertical axis 114, foimed by the sleeve 110 defines a geometric figure. As shown in FIGS. 1 and 2, the cross-sectional shape of the sleeve 110 comprises a lens shape. In other embodiments, the cross-sectional shape of the sleeve 110 may comprise a polygon, such as a triangle, a rectangle, etc., or a geometric figure with one or more curves, such as a circle, an oval, etc. (see FIG. 10). The geometric shape defined by the outer perimeter 140 of each insert 130, when in its unfolded position, substantially corresponds to the cross-sectional shape of the three-dimensional figure to be formed by the sleeve 110, such that the insert 130 helps to define the three-dimensional figure and provides support to the sleeve 110 to maintain the three-dimensional figure.

For example, as shown in FIGS. 1, 2, and 3A, the shape of the outer perimeter 140 of the inserts 130 substantially corresponds to the cross-sectional lens shape formed by the sleeve 110 when in its deployed position. In other embodiments, the inserts 130' may comprise a substantially rectangular shape, as shown in FIG. 3B, which may be used in a sleeve 110 with a rectangular cross-sectional shape (see FIG. 10). In embodiments in which the inserts 130 comprise one or more cutouts 134 extending inward from the outer perimeter 140, the cutouts 134 may be located such that a sufficient amount of the outer perimeter 140 of the inserts 130, 130' contacts the interior surface 116 of the sleeve 110 to form and support the three-dimensional figure. For example, as shown in FIGS. 3A and 3B, the cutouts 134 in the inserts 130, 130' are spaced away from the tabs 132 and away from the vertices of the lens shape and the rectangle shape, i.e., the areas adjacent to a point of maximum curvature and where adjacent sides of the geometric figure meet.

One or more of the internal perimeter 141, 141' of the sleeve 110 and the cross-sectional shape of the three-dimensional figure may vary along at least a portion of the longitudinal axis 114 of the sleeve 110. For example, in some embodiments, the sleeve 110 may comprise a uniform cross-sectional shape along the longitudinal axis 114, as shown in FIG. 1, but a lateral width $W_2$ and an internal perimeter 141' of one end portion, e.g., the second end portion 113, may be greater than a lateral width $W_1$ and an internal perimeter 141 at the other end portion 111, as illustrated by the dashed lines. In other embodiments, the end portions 111, 113 of the sleeve 110 comprise the same lateral width, e.g., $W_1$, but one or more intermediate portions of the sleeve 110 may be wider or narrower than the end portions 111, 113, e.g., width $W_3$, as illustrated by the dashed lines.

Figure 10:
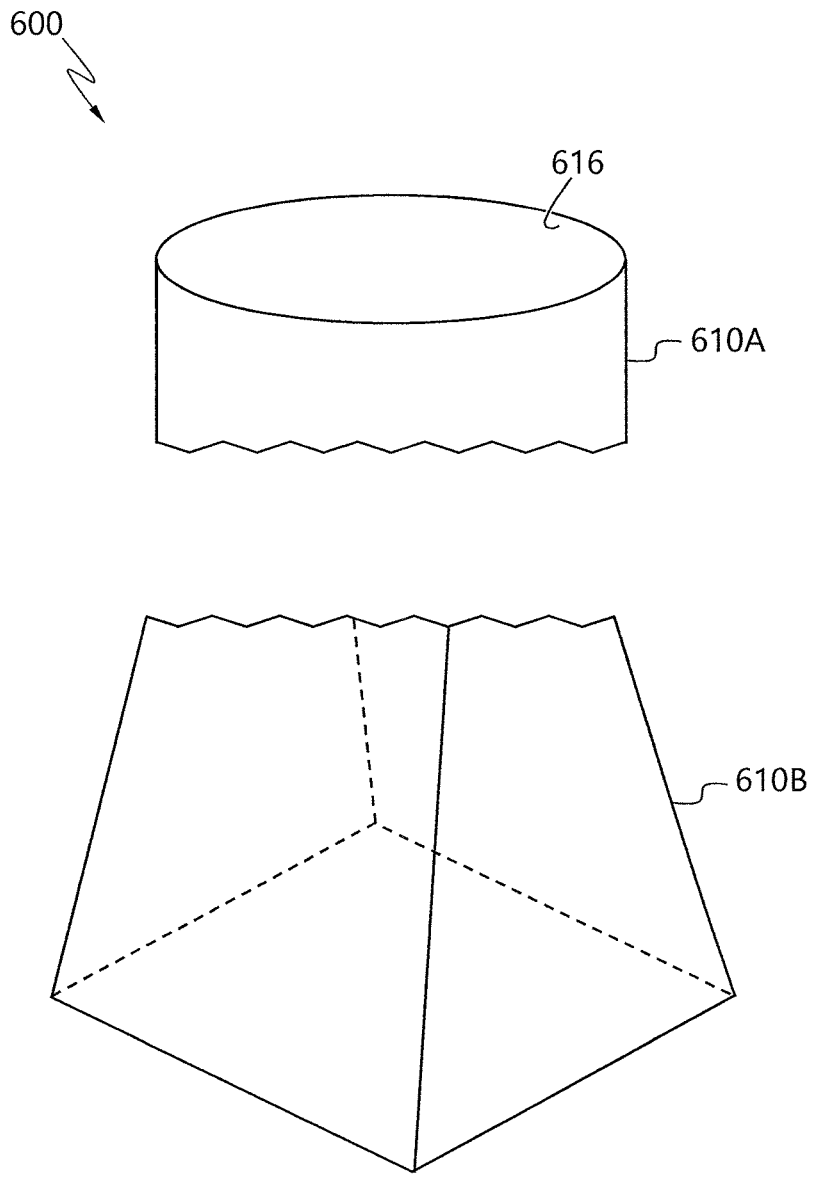
FIG. 10 is a perspective view of an embodiment of a display, in accordance with the present disclosure, in which one portion of the sleeve comprises one cross-sectional shape and another portion of the sleeve comprises a second cross-sectional shape.

In further embodiments as shown in FIG. 10, one portion 610B of the sleeve 610 may comprise one cross-sectional shape, e.g., a square or a rectangle, while another portion 610A of the sleeve 610 may comprise a second cross-sectional shape, e.g., a circle or an ellipse. In embodiments of the display 100, 600 in which the internal perimeter 141, 141' of the sleeve 110 and/or the cross-sectional shape of the three-dimensional figure are not uniform along the longitudinal axis 114 of the sleeve 110, 610, one or more of the dimension and the shape of the outer perimeter 140 of the inserts 130, 130' may vary in correspondence with the internal perimeter 141, 141' and the cross-sectional shape of the adjacent sections of the interior surface 116, 616 of the sleeve 110, 610.

One or more portions of an outer surface (not separately labeled) of the sleeve 110 define one or more faces on which information may be displayed, as described herein. The portion(s) of the outer surface defining the one or more faces of the sleeve 110 may be spaced apart from each other when the display 100 is in the deployed position. As shown in FIGS. 1 and 2, the cross-sectional shape of the sleeve 110 comprises a lens with two, opposing faces 119, 120 that are spaced apart from each other when the display is in the deployed position. The cross-sectional shape of the sleeve 110 may define three or more faces. For example, a sleeve 110 with a triangular cross-sectional shape (not shown) may comprise three faces, a sleeve 110 (with a square cross-sectional shape (see FIG. 10) may comprise four faces, etc.

Figure 4:
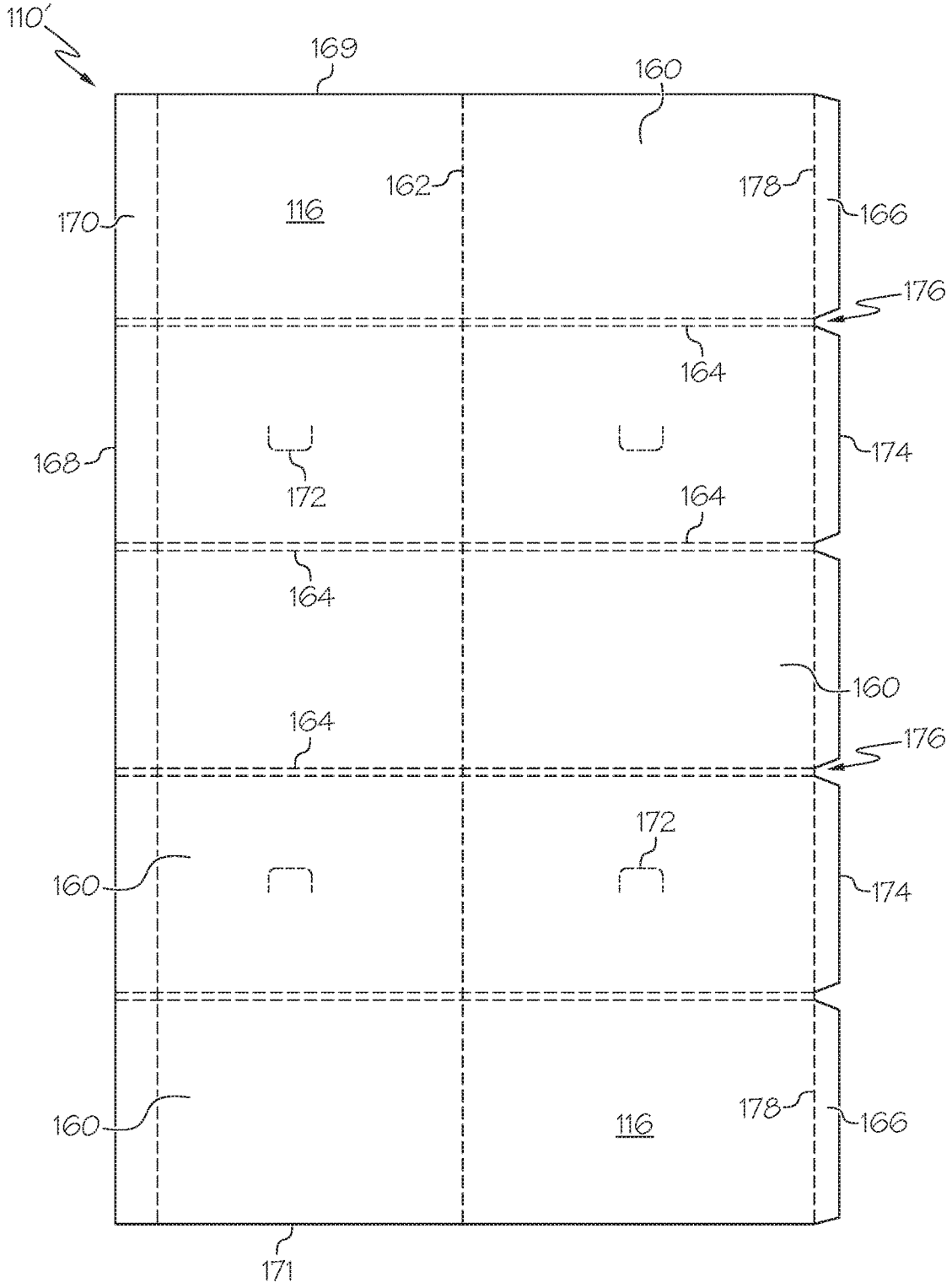
FIG. 4 is a top view of an interior surface of the sleeve of FIG. 1 prior to assembly of the display.

Assembly of the display 100 shown in FIG. 1 is described with respect to FIGS. 2-4. FIG. 4 comprises a top view of the interior surface 116 of the sleeve 110' prior to assembly of the display 100. The sleeve 110' comprises a substantially planar sheet with a plurality of connected, foldable panels 160 defined by at least one longitudinal fold line 162 and a plurality of lateral fold lines 164. The fold lines 162, 164 may comprise a pre-creased or scored portion of the sleeve 110'. A plurality of notches 176 may be cut into one edge 174 of the sleeve 110' near each of the lateral fold lines 164 to define a corresponding plurality of elongated tabs 166 extending longitudinally along the edge 174. The sleeve 110' may comprise paperboard or other suitable lightweight, flexible material.

To assemble the sleeve 110 as shown in FIGS. 1 and 2, the sleeve 110' is folded approximately in half along the longitudinal fold line 162, and each of the elongated tabs 166 is folded along a perforated or scored fold line 178 toward the interior surface 116 of the sleeve 110'. An outer surface (not shown) of each elongated tab 166 is attached to a corresponding portion 170 of the interior surface 116 of an opposite edge 168 of the sleeve 110', as shown in FIGS. 2 and 4. The elongated tabs 166 may be attached to the portion 170 using, for example, an adhesive or a mechanical connector, e.g., staples.

To install the inserts 130 in the assembled sleeve 110, the tabs 132 on each insert 130 are folded in a same direction along the perforated or scored fold line 133 so that the tabs 132 are substantially perpendicular to a plane of the insert 130. The two inserts 130 may be placed in the sleeve 110 such that the tabs 132 of one insert 130 are pointed toward the tabs 132 of the other insert 130, as shown in FIG. 1. An outer surface (not separately labeled) of each tab 132 is attached to the attachment point 172 (depicted with dashed lines in FIG. 4) located on the interior surface 116 of the sleeve 110 using, for example, an adhesive or a mechanical connector. As shown in FIGS. 2 and 4, the attachment point 172 is spaced apart from the lateral fold lines 164 such that the inserts 130, when installed, are attached to and contained within one of the panels 160. In some embodiments, the attachment point 172 is located at a point that is substantially equidistant between two lateral fold lines 164 or between a lateral fold line 164 and an outer edge 169, 171 of the sleeve 110. The inserts 130 may comprise paperboard. In particular, the inserts 130 may comprise a stronger type of paperboard such as corrugated Kraft board, as compared to the paperboard used for the sleeve 110, in order to provide sufficient support to the sleeve 110.

Figure 6:
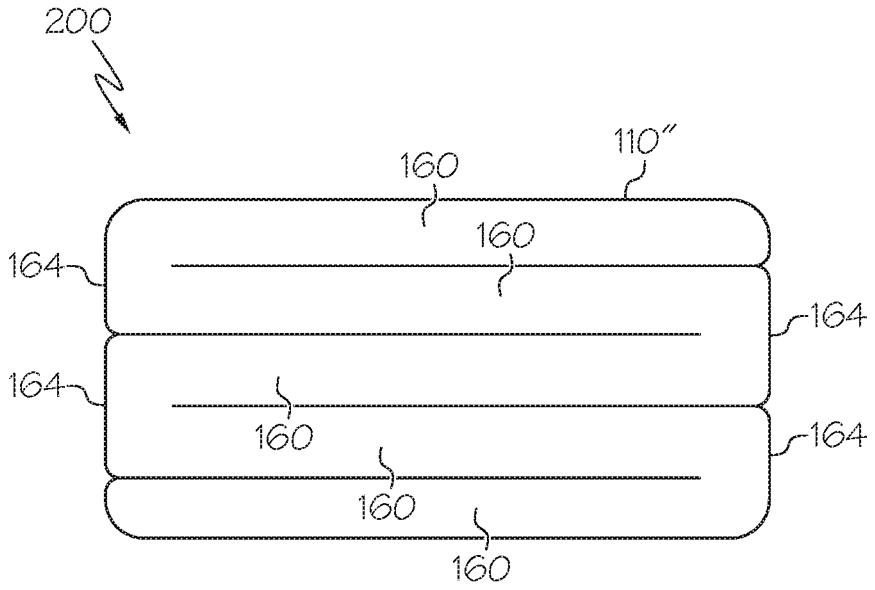
FIG. 6 is a side view of the display of FIG. 4 in a fully folded position, in accordance with the present disclosure.

In some embodiments of the sleeve 110', each lateral fold line 164 may comprise two, parallel fold lines spaced a short distance apart longitudinally to accommodate the thickness of the panels 160 and the inserts 130 when the display 100 is in a collapsed or folded position (see FIG. 6). In other embodiments (not shown), the sleeve 110' may comprise two or more sheets that are glued or otherwise attached together. In further embodiments (not shown), the number and/or location of the longitudinal and/or lateral fold lines 162, 164 may be varied to create a display 100 with the desired properties. For example, the number of panels 160 may be increased or decreased by altering the number of the longitudinal and/or lateral fold lines 162, 164. The number and location of the longitudinal fold lines 162 may also be altered such that the assembled sleeve 110 comprises a desired three-dimensional shape and/or a desired number of faces.

Figure 5:
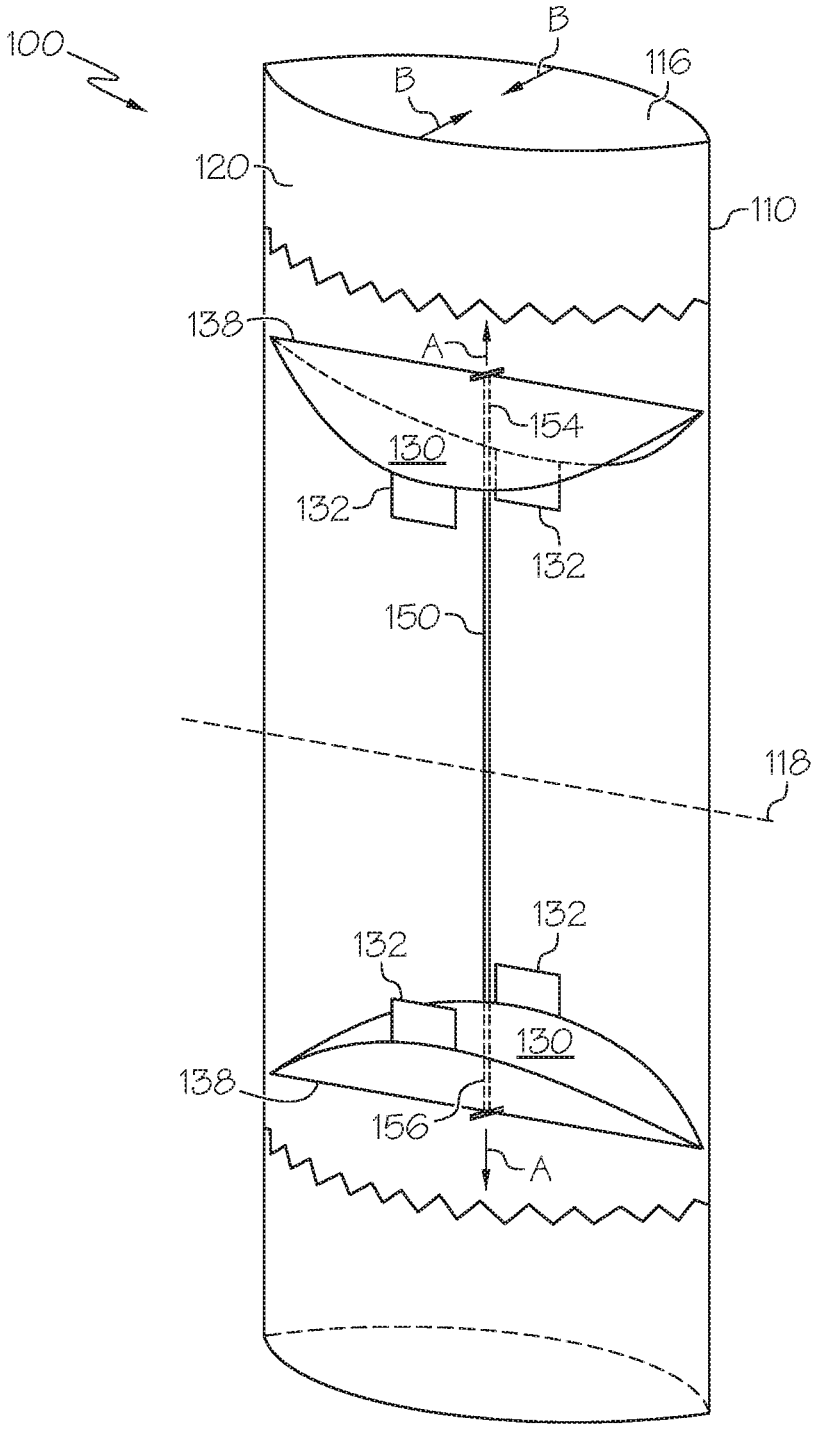
FIG. 5 a perspective view of the display of FIG. 1 in a partially collapsed position, in which a portion of the sleeve is cut away to illustrate the internal structure of the display.

When the display 100 is not in use, the display 100 may be in a folded or collapsed position, as shown in FIGS. 5 and 6. Some details and labeling are omitted from FIGS. 5 and 6 for clarity and to illustrate other aspects of the display 100 in detail. In FIG. 5, the display 100 is depicted in a partially collapsed position. The inserts 130 are in a partially folded position in which the inserts 130 are folded along their hinge lines 138 in a manner that increases a distance between at least a portion of the two inserts 130. For example, because each insert 130 is each attached to the interior surface 116 of the sleeve 110, folding the inserts 130 in opposing directions away from each other causes a portion of each insert 130, e.g., the area adjacent to the hinge line 138, to move away from the corresponding portion of the other insert 130, as shown by arrows A. In the embodiment shown in FIG. 5, the inserts 130 are positioned on either side of the lateral axis 118 of the sleeve 110 such that folding of the inserts 130 also results in movement of the portion of each insert 130 away from the lateral axis 118. A user may insert his or her fingers into the holes (not shown; reference number 136 in FIG. 2) and pull to assist the inserts 130 in folding.

Because the elastic member 150 is coupled to the inserts 130, the increase in distance between the inserts 130 causes the elastic member 150 to elongate and stretch as the ends 154, 156 of the elastic member 150 move away from each other. This stretching of the elastic member 150 causes the elastic member 150 to undergo elastic deformation and increases an amount of tension exerted by the ends 154, 156 of the elastic member 150 on the inserts 130.

As the inserts 130 are folded, a distance between at least a portion of the two inserts 130 remains substantially the same as when the inserts 130 were in their unfolded position. For example, because the inserts 130 are attached to the interior surface 116 of the sleeve 110, the portion of each insert 130 adjacent to the attachment point 172 (FIG. 4), e.g., the tabs 132, remains spaced apart at substantially the same distance from the corresponding portion of the other insert 130 during the folding process. As each insert 130 is folded, one tab 132 of the insert 130 moves laterally toward the other tab 132 of the insert 130. This lateral movement of the tabs 132 pulls the two faces 119, 120 (only 120 is shown in FIG. 5; see FIG. 2) of the sleeve 110 toward each other, as shown by arrows B, to collapse the sleeve 110.

When the inserts 130 are in a fully folded position, the two faces 119, 120 of the sleeve 110 are substantially parallel to one another such that the sleeve 110 is in a substantially planar or flattened state. As shown in FIG. 6, the panels 160 of the flattened sleeve 110" are then folded along the lateral fold lines 164 in opposing directions in an accordion fold to form a folded display 200 (see also FIG. 4). Because the attachment point 172 (FIG. 4) of the tabs 132 for each insert 130 is spaced apart from the lateral fold lines 164, the inserts 130 are each contained within one of the panels 160 (not shown) such that the inserts 130 do not interfere with folding of the panels 160 along the lateral fold lines 164 as the display 100 moves from the deployed position to the collapsed position. The folded display 200 is substantially planar, which reduces the amount of space required to store or transport the folded display 200.

To deploy the folded display 200, the above steps are reversed to unfold the panels 160 and move the inserts 130 from the folded position to the unfolded position, as shown in FIG. 1. The user may open the sleeve 110 and press on the hinge line 138 of the inserts 130 to assist in unfolding. In addition, the display 100 is at least partially self-deploying. As shown in FIG. 5, folding of the inserts 130 increases the distance between the inserts 130, which causes the elastic member 150 to stretch and increases the tension exerted by the ends 154, 156 of the elastic member 150 on the inserts 130. This stretching of the elastic member 150 generates a force that biases each insert 130 back toward its unfolded position, in which the distance between the inserts 130 and the ends 154, 156 of the elastic member 150 decreases. This decrease in distance allows the elastic member 150 to move to a lower tension state and return toward its original shape and dimensions as the stretching of the elastic member 150 is reduced.

The disclosed display 100 may be employed in a variety of settings for different purposes. Information may be printed or otherwise displayed on one or more of the faces 119, 120 of the sleeve 110, and additional items may optionally be attached to the sleeve 110 to augment the information and make the display 100 more visible. The display 100 may be used for example, at a point of sale to advertise information about goods and services offered by a merchant or at a trade show to provide information about a company's products and services, and in a variety of industries, such as the retail, financial, restaurant, and entertainment industries.

Because of the ease with which the disclosed display 100 may be set up and taken down for storage or transport, the display 100 provides a reusable and highly portable means for presenting information in a highly visible manner. Once assembled, all components of the display 100 remain attached, with no need to repeatedly attach and detach, for example, the elastic member 150 each time the display 100 is deployed and collapsed. In addition, the simplicity of the design, the relatively limited number of cuts, and the use of a single elastic member 150 per pair of inserts 130 also reduces the manufacturing labor and cost. Because the sleeve 110 and inserts 130 may be made from paperboard, the display 100 is cost-effective for the end user and may be discarded or recycled at the end of its life.

Figure 7:
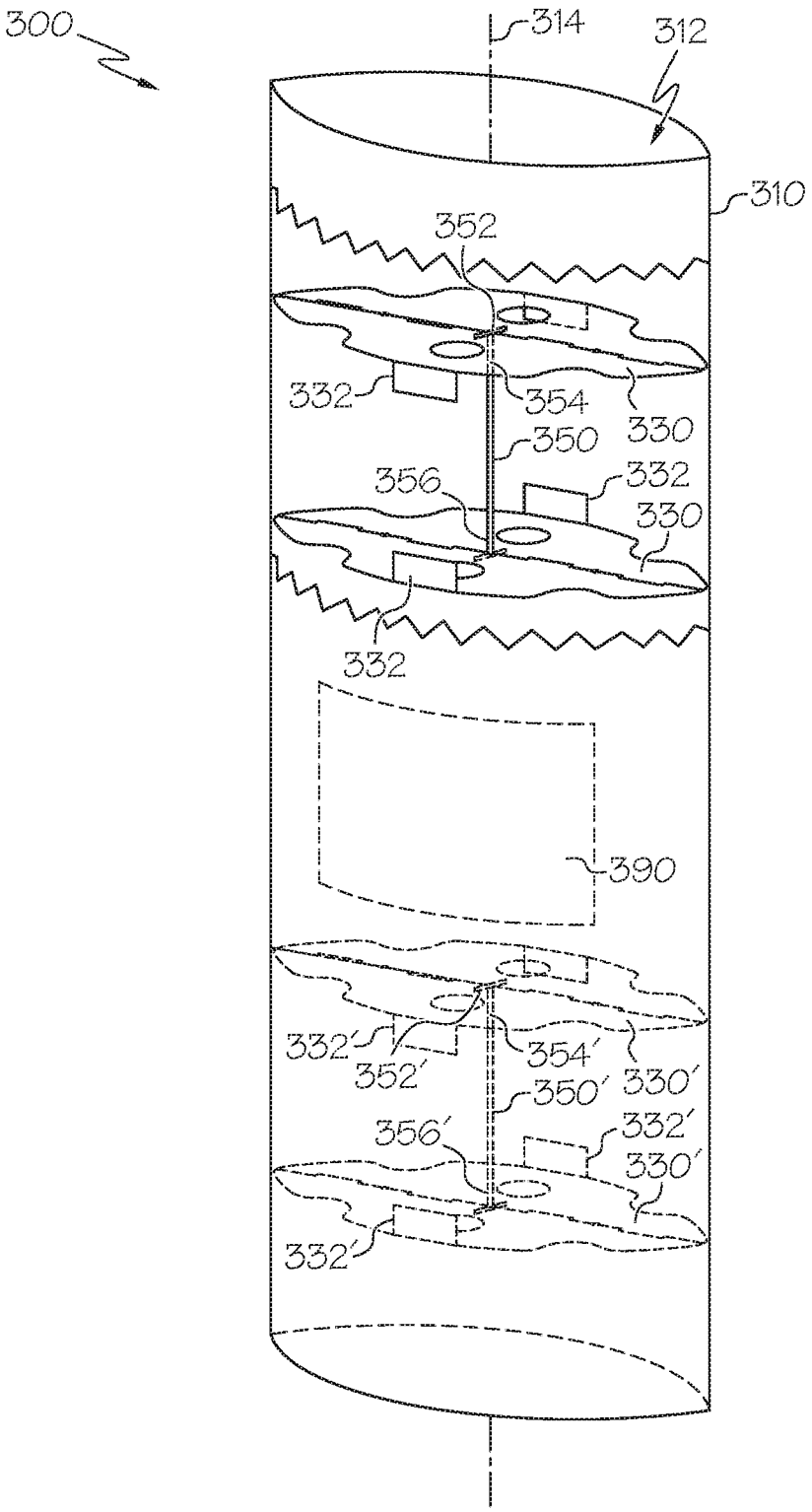
FIG. 7 is a perspective view of another embodiment of a display, in accordance with the present disclosure.

Some embodiments of the display 300 may comprise two or more pairs of inserts 330, 330', as shown in FIG. 7. The display 300 in FIG. 7 comprises two pairs of inserts 330, 330' each comprising tabs 332, 332', in which one elastic member 350 extends between one of the pairs of inserts 330, and another elastic member 350' extends between the other pair of inserts 330'. Similar to the embodiment shown in FIG. 1, a first end 354, 354' of the elastic member 350, 350' is coupled to one of the inserts 330, 330' in each pair, and a second end 356, 356' of the elastic member 350, 350' is coupled to the other insert 330, 330' in each pair. The elastic member 350, 350' may comprise, for example, a barb 352, 352' or other suitable fastener that couples each end 354, 354', 356, 356' of the elastic member 350, 350' to a respective one of the inserts 330, 330' in each pair. In other embodiments, the display 300 may comprise more than two pairs of inserts (not shown), and in other embodiments (not shown), two or more elastic members may extend between the pairs of inserts. These additional inserts and/or elastic members may be used, for example, to provide additional stability for displays 300 having a greater vertical height and/or displays 300 with a greater lateral width, e.g., $W_2$. In all embodiments, the number of inserts will be an even number such that each pair of inserts comprises an elastic member extending between the two inserts of each pair.

Although some components and labeling are omitted from FIG. 7 for clarity, it is understood that the inserts 330, 330' and the sleeve 310 of the display 300 may be structurally and functionally similar to the corresponding components of the display 100 described herein and depicted in FIGS. 1-6 and that the display 300 may be assembled, deployed, and collapsed in substantially the same manner described with respect to the display 100. For example, when the display 300 is moved from a deployed position as shown in FIG. 7 to a collapsed or folded position (not shown), the inserts 330 in one pair are folded in a manner that increases a distance between at least a portion of the two inserts 330, and the inserts 330' in the other pair are folded in a manner that increases a distance between at least a portion of the two inserts 330', as shown in FIG. 5 with respect to the display 100. This increase in distance also causes the first ends 354, 354' of the elastic members 350, 350' to move away from the respective second ends 356, 356' as the elastic members 350, 350' elongate and stretch. This stretching of the elastic members 350, 350' increases an amount of tension exerted by the ends 354, 354', 356, 356' of each elastic member 350, 350' on its respective insert 330, 330'. Following folding of the inserts 330, 330' and flattening of the sleeve 310, the panels (not labeled; reference number 160 in FIG. 4) of the sleeve 310 may be folded along one or more lateral fold lines (not labeled; reference number 164 in FIG. 4) in opposing directions in an accordion fold to form a folded display, similar to the folded display 200 shown in FIG. 6.

When the display is moved back to the deployed position, the inserts 330, 330' are moved from a folded position to an unfolded position, in which the inserts 330, 330' are substantially planar and are substantially perpendicular to the longitudinal axis 314 of the sleeve 310, as shown in FIG. 7. Movement of each insert 330, 330' to its unfolded position decreases the distance between the two inserts 330, 330' of each pair. This decrease in distance also causes the respective ends 354, 354', 356, 356' of each elastic member 350, 350' to move closer to one another such that stretching of each elastic member 350, 350' decreases and each elastic member 350, 350' moves to a lower tension state. As described herein, the stretching of the elastic members 350, 350' caused by folding of the inserts 330, 330' as the display 300 transitions to the collapsed position generates a force that biases each insert 330, 330' back toward its unfolded position, such that the display 300 is at least partially self-deploying.

With continued reference to FIG. 7, some embodiments of the display 300 may optionally comprise one or more windows 390 extending through a thickness of the sleeve 310 into an interior 312 of the sleeve 310. As shown in FIG. 7, the window 390 may comprise a substantially rectangular shape, and in other embodiments (not shown), one or more of the windows 390 may comprise another shape, such as a circle or a triangle. Also as shown in FIG. 7, each of the one or more pairs of inserts 330, 330' may be located above or below the window 390 so that inserts 330, 330' and the elastic members 350, 350' are not visible in the window 390. A transparent or translucent material (not separately labeled) may optionally be used to cover the window 390.

Figure 8A:
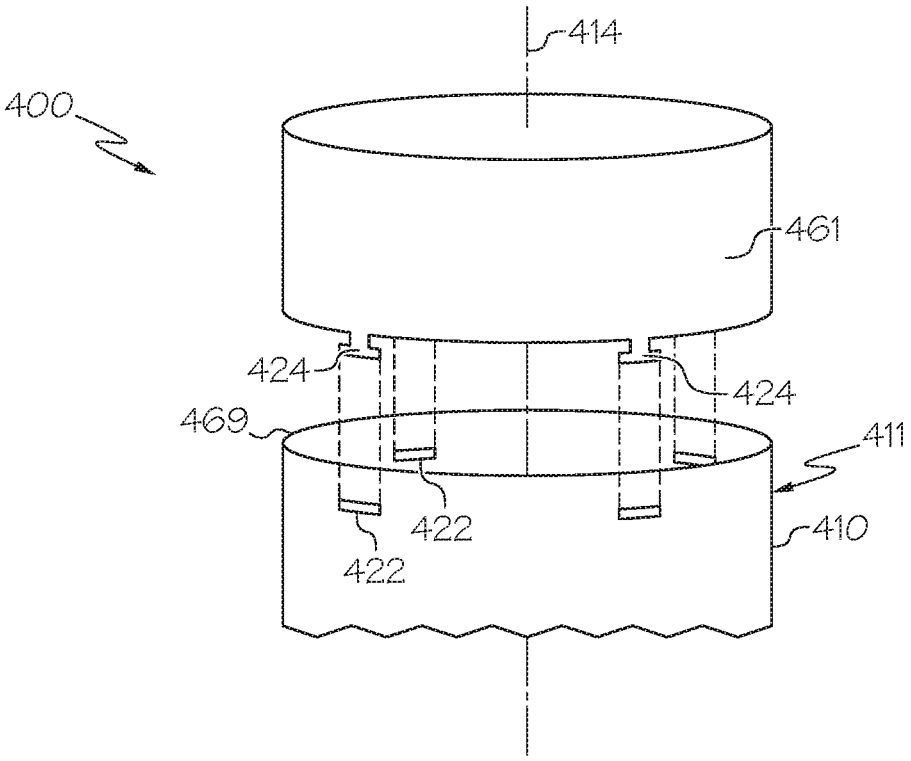
FIGS. 8A and 8B are enlarged, perspective views of portions of embodiments of a display comprising a detachable panel and a telescoping panel, in accordance with the present disclosure.
Figure 8B:
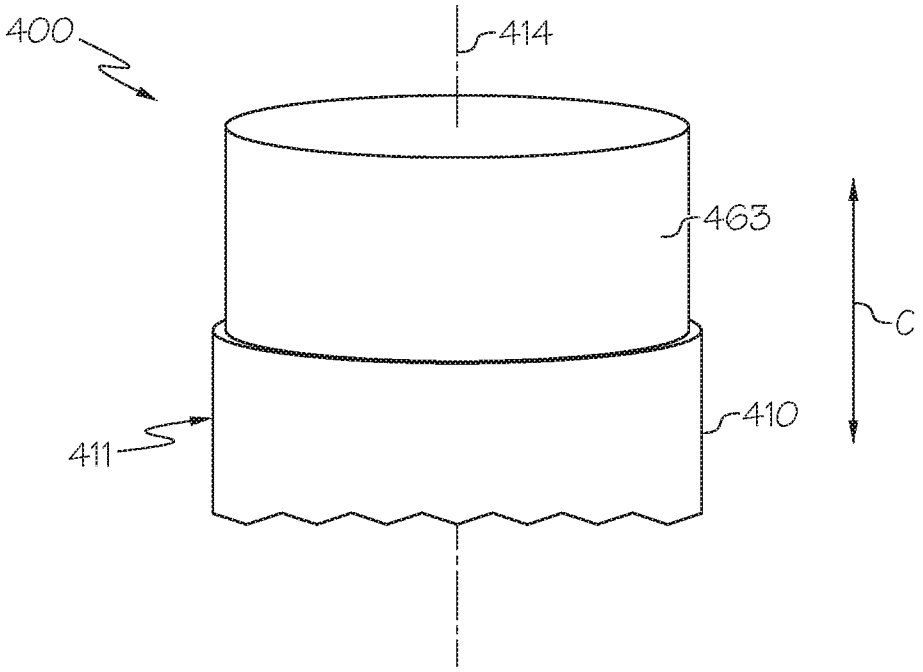

In further embodiments, the display 400 may optionally comprise one or more additional panels 461, 463, as shown in FIGS. 8A and 8B. In FIG. 8A, a first end portion 411 of the sleeve 410 comprises a plurality of slits 422 located near the outer edge 469 of the sleeve 410. The slits 422 receive a plurality of tabs 424 extending from a detachable panel 461. The detachable panel 461 may share a same longitudinal axis 414 with the sleeve 410 and may be concentric with the sleeve 410. An internal perimeter and cross-sectional shape of the detachable panel 461 may be such that the detachable panel 461 either nests within the first end portion 411 of the sleeve 410 or fits over the outside of the sleeve 410. The other end portion (not shown; reference number 113 in FIG. 1) may also optionally comprise a detachable panel 461 as described.

In the embodiment shown in FIG. 8B, the display 400 comprises a telescoping panel 463 that extends from the first end portion 411 of the sleeve 410. The telescoping panel 463 may be fixed at one end to one or more portions of the interior surface (not labeled; reference number 116 in FIG.

2) of the sleeve 410. The telescoping panel 463 may share a same longitudinal axis 414 with the sleeve 410 and may be concentric with the sleeve 410. An internal perimeter of the telescoping panel 463 may be less than an internal perimeter of the first end portion 411 of the sleeve 410 such that the telescoping panel 463 fits within the sleeve 410. The telescoping panel 463 moves in and out of the first end portion of the sleeve 410 substantially along the longitudinal axis 414, as shown by arrow C.

In yet further embodiments, the display 500 may optionally comprise a cap 580 located at one end portion, e.g., a first end portion 511, and/or a base 582 located at the other end portion, e.g., a second end portion 513, as shown in FIG. 9. The cap 580 and/or base 582 may extend beyond the end portions 511, 513 of the sleeve 510, as shown, or the cap 580 and/or base may 582 may be located at or just within the outer edges 569, 571 or the end portions 511, 513 of the sleeve 510 (not shown). The cap 580 and the base 582 may also be detachable so that the user may access the interior 512 of the sleeve 510 in order to move the display 500 between the deployed to the collapsed position.

While particular embodiments of the present invention have been illustrated and described, it should be understood that various changes and modifications may be made without departing from the spirit and scope of the invention. It is therefore intended to cover in the appended claims all such changes and modifications that are within the scope of this invention.

What is claimed is:

1. A foldable display comprising:

a sleeve comprising a plurality of connected foldable panels and defining a longitudinal axis;

two inserts spaced apart in an interior of the sleeve, wherein each insert is coupled to an adjacent portion of an interior surface of the sleeve and comprises one or more cutouts extending inward from an outer perimeter of the insert, the outer perimeter of each insert defining a geometric shape, wherein each insert comprises a hinge line located along a longitudinal centerline of the insert, the cutouts being spaced away from vertices of the geometric shape and spaced away from the hinge line; and an elastic member comprising a first end coupled to one of the two inserts and a second end coupled to the other of the two inserts such that the elastic member extends between the two inserts, wherein:

when the foldable display is in a collapsed position, the sleeve is in a flattened state and each insert is in a folded position that increases a distance between the two inserts and causes the elastic member to stretch; and when the foldable display is in a deployed position, each insert is in an unfolded position that decreases the distance between the two inserts, wherein one or more sections of the outer perimeter of each insert contact one or more adjacent sections of the interior surface of the sleeve and bias the sleeve outward such that the sleeve forms a three-dimensional figure.

2. The foldable display of claim 1, wherein the single elastic band moves to a lower tension state when the inserts move from their folded position to their unfolded position.

3. The foldable display of claim 1, wherein the single elastic band extends between the two inserts substantially along the longitudinal axis of the sleeve.

4. The foldable display of claim 1, wherein the single elastic band is coupled to the hinge line of the two inserts and wherein:

when the foldable display is in the collapsed state, each insert is folded along the hinge line such that a portion of each insert moves away from a corresponding portion of the other insert to increase the distance between the two inserts; and when the foldable display is in the deployed state, each insert is unfolded such that the portion of each insert moves toward the corresponding portion of the other insert to decrease the distance between the two inserts.

5. The foldable display of claim 1, wherein when the foldable display is in the deployed state, each insert is substantially planar and is substantially perpendicular to the longitudinal axis of the sleeve.

6. The foldable display of claim 1, wherein a cross-sectional shape of the three-dimensional figure comprises one of a curved geometric figure or a polygon.

7. The foldable display of claim 6, wherein a shape of the outer perimeter of each insert, when in its unfolded position, substantially corresponds to the cross-sectional shape of the three-dimensional figure and the outer perimeter of each insert substantially corresponds to an internal perimeter of the sleeve.

8. The foldable display of claim 7, wherein at least one of the internal perimeter of the sleeve or the cross-sectional shape of the three-dimensional figure varies along at least a portion of the longitudinal axis of the sleeve.

9. The foldable display of claim 1, wherein each insert comprises at least one hole through which one or more fingers are inserted for moving the foldable display between the deployed position and the collapsed position.

10. The foldable display of claim 1, wherein each insert comprises two or more tabs extending from the outer perimeter of the insert for coupling the insert to the adjacent portion of the interior surface of the sleeve.

11. The foldable display of claim 1, wherein a force generated by the single elastic band being in tension when the inserts are in their folded positions biases each insert toward its unfolded position such that the foldable display is at least partially self-deploying.

12. The foldable display of claim 1, wherein the sleeve comprises a midsection defining a first sleeve portion and a second sleeve portion, one of the inserts being located in the first sleeve portion and the other of the inserts being located in the second sleeve portion.

13. The foldable display of claim 1, wherein the sleeve comprises a plurality of fold lines extending substantially perpendicular to the longitudinal axis of the sleeve and defining the plurality of connected foldable panels.

14. The foldable display of claim 13, wherein:

each insert is located within one of the panels; and the sleeve is foldable along the fold lines such that when the foldable display is in the collapsed position, the panels are folded in opposing directions, to form a folded display.

15. The foldable display of claim 14, wherein the folded display is substantially planar.

16. The foldable display of claim 1, further comprising one or more additional panels, wherein the one or more additional panels comprise at least one of a detachable panel or a telescoping panel, the one or more additional panels comprising a same longitudinal axis as the sleeve and an internal perimeter that is substantially equal along an entirety of the longitudinal axis of the detachable panel.

17. The foldable display of claim 1, further comprising at least one of a cap or a base.

18. A foldable display comprising:

a sleeve comprising a plurality of connected foldable sections and defining a longitudinal axis;

at least two pairs of inserts spaced apart in an interior of the sleeve, wherein each insert is coupled to an adjacent portion of an interior surface of the sleeve; and an elastic member extending between the inserts in each pair of inserts, wherein a first end of the elastic member is coupled to one of the inserts and a second end of the elastic member is coupled to the other of the inserts, wherein:

when the foldable display is in a collapsed position, the sleeve is in a flattened state and the inserts are in a folded position that increases a distance between the inserts in each pair of inserts and causes the respective elastic member to stretch; and when the foldable display is in a deployed state, the inserts are in an unfolded position that decreases the distance between the inserts in each pair of inserts and causes ends of the respective elastic member to move closer to one another, wherein one or more sections of an outer perimeter of each insert contact one or more adjacent sections of the interior surface of the sleeve and bias the sleeve outward such that the sleeve forms a three-dimensional figure.

19. The foldable display of claim 18, wherein the sleeve comprises at least one window, each pair of inserts being located above or below the at least one window.

* * * * *